US005098587A

United States Patent [19]

Hoornaert et al.

[11] Patent Number: 5,098,587

[45] Date of Patent: Mar. 24, 1992

[54] PROCESS FOR THE PREPARATION OF AN OVERALKALINIZED ADDITIVE CONTAINING A DERIVATIVE OF BORON, THE ADDITIVE THUS OBTAINED AND LUBRICANT COMPOSITIONS CONTAINING SAID ADDITIVE

[75] Inventors: Pierre Hoornaert, Saint Pierre De Chandieu; Claude Rey, Lyons; Roger Gallo, Bouc Bel Air; Catherine Belle, Marseille, all of France

[73] Assignee: Elf France, Courbevoie, France

[21] Appl. No.: 546,670

[22] Filed: Jun. 29, 1990

Related U.S. Application Data

[63] Continuation of Ser. No. 283,322, filed as PCT/FR88/00137, Mar. 16, 1988, abandoned.

[30] Foreign Application Priority Data

Mar. 17, 1987 [FR] France ..... 87 03646

[51] Int. Cl.[5] ..... C10M 125/10

[52] U.S. Cl. ..... 252/33.4; 252/18; 252/40.5; 252/40.7; 252/42; 252/42.1

[58] Field of Search ..... 252/33.4, 18, 40.5, 252/40.7, 42, 42.1

[56] References Cited

U.S. PATENT DOCUMENTS

| | | | |
|---|---|---|---|
| 3,480,548 | 11/1969 | Hellmuth et al. | 252/33.4 |
| 3,679,584 | 7/1972 | Hellmuth | 252/33.4 |
| 3,829,381 | 8/1974 | LeSuer | 252/33.4 |
| 3,907,691 | 9/1975 | King et al. | 252/33.4 |
| 3,929,650 | 12/1975 | King et al. | 252/33.4 |
| 4,059,536 | 11/1977 | Lallement et al. | 252/33.4 |
| 4,560,489 | 12/1985 | Muir et al. | 252/33.4 |
| 4,601,837 | 7/1986 | Valcho et al. | 252/33 |
| 4,659,488 | 4/1987 | Vinci | 252/33.4 |
| 4,683,126 | 7/1987 | Inoue et al. | 252/33.4 |
| 4,744,920 | 5/1988 | Fisher et al. | 252/33.4 |
| 4,758,360 | 7/1988 | Bernasconi et al. | 252/33.4 |
| 4,965,003 | 10/1990 | Schlicht | 252/38 |
| 4,965,004 | 10/1990 | Schlicht et al. | 252/38 |

*Primary Examiner*—Prince Willis, Jr.
*Assistant Examiner*—Jerry D. Johnson
*Attorney, Agent, or Firm*—Burgess, Ryan & Wayne

[57] ABSTRACT

A process is provided for the preparation of an overalkalinized additive for lubricant oils which consists of carbonating a reaction mixture composed of at least one detergent, one derivative of alkaline or alkaline earth metal, at least one nitrogenized and/or oxygenated promoter in a diluent oil and a hydrocarbonated solvent, and wherein the operation is carried out in the presence of at least one boron derivative. Also provided, the additives thus obtained and lubricant compositions containing the additive. These additives are homogeneous and stable, and have very good antiwear properties.

29 Claims, No Drawings

PROCESS FOR THE PREPARATION OF AN OVERALKALINIZED ADDITIVE CONTAINING A DERIVATIVE OF BORON, THE ADDITIVE THUS OBTAINED AND LUBRICANT COMPOSITIONS CONTAINING SAID ADDITIVE

This application is a continuation of application Ser. No. 283,322, filed as PCT/FR88/00137, Mar. 16, 1988, now abandoned.

FIELD OF THE INVENTION

This invention concerns a process for the preparation of an overalkalinized additive for lubricant oils containing a boron derivative, the additive thus obtained and a lubricant composition containing said additive.

BACKGROUND OF THE INVENTION

Fuels, particularly those used in heavy fuel engines, contain increasingly large quantities of sulfur. At the same time the conditions of operation become more strict.

It has become necessary to add to lubricant oils different additives that improve their properties. Among such additives are found the detergents, the dispersants, additives against wear and extreme pressure, and additives that contribute a reserve of basicity.

The detergent and dispersant properties of a lubricant correspond to its ability to maintain in suspension the impurities and incombustible substances in the hot parts of the engine by its detergent action, but equally in the cold parts by its dispersant action. The fixation of these particles in the form of varnishes or lacquers is thus prevented.

The part played by the additives with a reserve of basicity consists in fighting the acidity induced in the engines by the combustion of the sulfurized organic derivatives contained in the engine fuels and by oxidation of the components of the lubricant oils.

The anti-wear additives act by formation of a solid or plastic thin film that separates the parts of the engine.

The detergent and dispersant properties the same as the reserve of basicity are in general contributed by overalkalinized additives. They are carbonates of alkaline or alkaline earth metals in a detergent solution of the sufonate, phenate, or salicylate alkyl type.

The anti-wear additives are in general sulfurized and/or phosphorized compounds, the most commonly used being the Zn dialkyl dithiophosphates.

The boron derivatives form another kind of antiwear additives. The mineral compounds of boron contribute an antiwear function and extreme pressure function (U.S. Pat. Nos. 3,907,691 and 4,100,081) while the organic compounds contribute antiwear and anti-friction properties (U.S. Pat. Nos. 4,549,975 and 4,599,183).

The incorporation of a boron compound in an overalkalinized additive will make it possible to have available a multifunctional additive having a reserve of basicity and detergent, dispersant and antiwear properties. Different methods of incorporation of the boron in an overalkalinized additive have been envisaged.

The most evident method would be to replace purely and simply the carbonic anhydride by the boric acid. This process has been envisaged in U.S. Pat. Nos. 3,853,774 and 4,601,837. But for reasons related to the difference of reactivity between the carbonic anhydride and the boric acid or anhydride, which have been pointed out in U.S. Pat. No. 3,785,976, this substitution has proved difficult.

The prior art was oriented toward boron compounds such as boric acid and the organic esters thereof, or to boron oxide which are then added to the classical previously overalkalinized additives containing calcium carbonate. Such mixtures described in U.S. Pat. Nos. 3,480,548, 4,089,790, 3,829,381 and 4,560,489 are undesirable from the point of view of their stability and their compatibility with the other additives of the lubricant formula.

In order to improve their stability, U.S. Pat. No. 3,929,650 claims the possibility of using a dispersant product of the alkenyl succinimide type.

U.S. Pat. No. 3,907,691 contemplates the formation of a complex by heating the intermediary product formed by reaction of the boric acid with the overalkalinized sulfonate. U.S. Pat. No. 4,539,126 claims the preparation of complexes by reaction of boric acid with an overalkalinized alkyl salicylate.

U.S. Pat. No. 3,928,216 indicates the use of catalytic quantities of boron salts of an amine during the overalkalinization reaction.

U.S. Pat. No. 3,679,584 suggests a mode of operation in two steps. To a classical overalkalinized additive prepared in a first step there are added in a second step the boric acid and the carbonic anhydride. But the alkaline value of the overalkalinized mixture drops very strongly during this second step, going, for example, from 295 to 177.

The alkaline value (AV) is nominally equivalent to the number of KOH milligrams per gram of overalkalinized additive tested by a strong acid. This value is determined by potentiometric dosing directly following the standard ASTM D-2896.

All the processes based on the mixture of a boron derivative with an already overalkalinized additive give products of poor stability in which the boron content and the alkaline value are equally low.

These mixtures are in general in liquid form and a of cloudy appearance. Unlike the alkaline earth carbonates that form colloidal dispersions, the boron derivatives remain in the form of coarse solid particles responsible for the cloudy appearance of the liquid. These solid particles in suspension could defeat the effect sought with the antiwear additives by causing, for example, the abrasion of the engines. When precipitating, they result in troublesome sediments and in a heterogeneity in the metal concentration.

This invention makes it possible to overcome these disadvantages and to prepare overalkalinized additives with a substantial boron content and an elevated alkaline value. Since the boron derivatives are incorporated in the globules of the colloidal dispersion, these additives are homogeneous and stable, and have very good antiwear properties.

SUMMARY OF THE INVENTION

The process of preparation of overalkalinized additives with antiwear effects according to the invention comprises in carbonating a reaction mixture composed of at least one detergent, one derivative of an alkaline or alkaline earth metal, at least one nitrogenized and/or oxygenated promoter in a diluent oil and a hydrocarbonated solvent, and where in the operation is carried out in the presence of at least one boron derivative.

DETAILED DESCRIPTION OF THE INVENTION

Inorganic or organic boron derivatives can be used in the present invention.

Among the inorganic boron derivatives there can be cited the boron oxides and anhydrides, as well as boric acid and the salts thereof. Particularly convenient are the boric acid and the ammonium salt thereof, the diammonium tetraborate ($(NH_4)_2 B_4O_7.4H_2O$) and the sodium salt thereof, the sodium tetraborate ($Na_2B_4O_7.nH_2O$) and the potassium salt thereof, the potassium tetraborate ($K_2B_4O_7.nH_2O$) and the lithium salt thereof, and the lithium tetraborate ($Li_2B_4O_7.SH_2O$).

Likewise one can mention the barium metaborale ($BaO.B_2O_3.nH_2O$), the manganese borate ($MNB_4O_7$) and the lead borate ($Pb(BO_2)_2$).

Amoung the organic boron derivatives, the esters of boric acid and the free or esterified alkyl and aryl boric acids are particularly useful.

The esters are formed with aliphatic and cyclic alcohols or with phenols.

The aliphatic alcohols are generally linear or branched chains of from $C_1$ to $C_{20}$ and preferably from $C_1$ to $C_4$.

Instead of monoalcohols there can be advantageously used the glycols having two hydroxyl groups in position 1-2, 1-3, or 1-4 such as glycol, propylene glycol, or neopentyl glycol, as well as the polyglycols such as diethylene glycol, dipropylene glycol, or tripropylene glycol.

Equally convenient are the polyols such as glycerol, trimethylol propane, or pentaerythritol.

It is equally possible to use alkoxy alkanols and preferably the alkoxy alkanols corresponding to the general formula $RO(CHR_1(CH_2)_a)—O—)_bH$ wherein R is an alkyl group having from $C_1$ to $C_4$, $R_1$ is hydrogen or an alkyl group having from $C_1$ to $C_3$, a has a value between 1 and 3 and b corresponds to 1 to 2.

As examples of alkoxy alkanols there can be mentioned the methoxyethanol, the ethoxyethanol or ETHYL-CELLOSOLVE and BUTYL-CELLOSOLVE.

The alcohols in which the molecule contains one or more amine functions are likewise suitable. Thus, it is possible to use alkanolamines such as diethanolamine or triethanolamine and the oxyalkylated alkyl mono- and polyamines.

The oxyalkylated alkyl monoamines correspond preferably to the formula $R_2NH_cZ_d$ wherein $R_2$ is hydrogen or an alkyl group with from $C_1$ to $C_{22}$, preferably from $C_{10}$ to $C_{18}$, Z corresponds to the group $—CHR_3—CH_2—OH$, $R_3$ being an alkyl group with from $C_1$ to $C_4$ or an aromatic nucleus, c can be 0 or 1 and c+d are equal to 2.

The oxyalkylated alkyl polyamines preferably correspond to the formula $R_2NZ_1—(CH_2)_e—NZ_2Z_3$ where $Z_1$, $Z_2$ and $Z_3$, identical or different, correspond to hydrogen and at least one of the three corresponds to Z defined above, $R_2$ has the same meaning as above.

Among the cyclic alcohols can be mentioned cyclopentanol, cyclohexanol and the derivatives thereof mono- and polyalkylated on the ring.

Among the phenols what is most commonly used is the phenol proper and the substituted derivatives thereof such as the cresol.

The esters of the boric acid can be prepared by any known method, specially by reaction of boron trichloride on the alcohols and phenols. In the case of esterification of the boric acid by the polyols, the water formed must be eliminated by azeotropic removal.

The derivatives of boron are used alone or mixed. According to their nature, the boron derivatives can be added to the reaction mixture in pulverized form, eventually previously dispersed in an oil, in the form of a aqueous solution, or in liquid form.

The commonly used detergents in the overalkalinized additives are salts of sulfonic acids, salicyclic acids, or phenols.

These detergents can be advantageously used mixed with alkyl succinamides of the general formula:

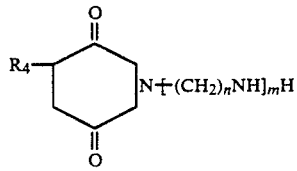

wherein $R_4$ is a hydrocarbon radical of from 12 to 100 carbon atoms, n is between 1 to 6 and m is between 1 and 5.

The sulfonic acids are of petroleum or synthetic origin. The medium molecular weight of petroleum sulfonates is in general above 320. They are obtained by sulfonation of petroleum distillates. The synthetic sulfonic acids are particularly useful in the scope of the invention. They can be products obtained by sulfonation of olefins having a number of carbon atoms above or equal to 12, or also alkyl aryl sulfonic acids.

The alkylarylsulfonic acids include one or more alkyl chains on an aromatic nucleus, generally a benzene nucleus. The alkyl chains must include a minimum of 8 carbon atoms. Their structure is linear or branched. There are commonly used alkylated benzene, toluene, xylene, or naphthalene with alpha-olefins of from $C_{13}$ to $C_{16}$ with paraffins of from $C_{20-22}$, or with propylene tetramers ($C_{24}$-benzenesulfonic acid).

The oil-soluble salicylic acids are replaced on the aromatic nucleus by a chain including at least 10 and in general from 16 to 18 carbon atoms.

The phenols soluble in a organic medium are useful of particular interest in the scope of the invention are phenols substituted by one or more linear or branched alkyl chains including at least 8 carbon atoms. The most common commercial products are, for example, nonyl phenol, dinonyl phenol, dodecyl phenol and mixtures thereof.

The phenols are used in the form of salts of alkaline or alkaline earth metals. They are particularly appreciated after having undergone a sulfurization by reaction with the sulfur or also with sulfur chloride.

The overalkalinized additives contain one or more of these detergents. The sulfonic and salicylic acids or the phenols can be used mixed with dispersants derived from alkenyl succinic acids of a chain above or equal to 12 carbon atoms, or with carboxylic acids having at least 8 carbon atoms.

The derivative of a alkaline or alkaline earth metal is generally an oxide, hydroxide, or alcoholate of such a metal.

The oxygenated promoters are mainly aliphatic alcohols, generally of from $C_1$ to $C_5$, most frequently methanol, ethanol, butanol, or glycols. Ethers such as dioxolane or dialkoxy methanes are likewise used. The alcohols can be used alone or mixed with water.

The nitrogenized promoters are, among others, ammonia, ethylene diamine, ethanolamines, ammonium chloride, or ammonium carbonate.

The part played by the diluent oil is to allow an easy manipulation at room temperature. There can be cited among these oils the paraffinic oils such as 75, 100, or 150 Neutral or the naphthenic oils, type 100 Pale solvent.

The hydrocarbon solvents have an aliphatic structure, as heptane, isooctane, nonane, or an aromatic structure, as toluene or xylene. These solvents can be used mixed. It is specially advantageous to use solvents that give azeotropes with water such as alcohols, glycols, or alkoxy alkanols.

To carry out the invention, there is generally used a reactor with double cover provided with a vigorous stirring system, a temperature regulator, a condenser, a system that makes it possible to obtain a vacuum or a slight suppression, a gas diffuser and a recovery system of solvents.

According to a preferred embodiment of the invention, there are introduced in the reactor:

from 100 to 500 parts by weight of detergents
from 100 to 300 parts by weight of a derivative of an alkaline or alkaline earth metal
from 0 to 100 parts by weight of a nitrogenized promoter
from 30 to 300 parts by weight of an oxygenated promoter
from 0 to 100 parts by weight of water
from 100 to 500 parts by weight of a diluent oil
from 200 to 800 parts by weight of a hydrocarbon solvent
from 15 to 400 parts by weight of a boron derivative.

If the boron derivatives are used in the form of a dispersion in oil, the dispersion is added to the reaction mixture prior to introducing the carbonic anhydride. The boron derivatives used in a dispersion are boric acid and the salts thereof. The boron derivatives used in pulverized form or in the form of aqueous solution, if their solubility is sufficient, are boron oxide, boric acid and salts thereof.

The boron derivatives used in liquid form are certain boric esters and alkyl or aryl boronic acids. The pulverized and liquid components or the aqueous solutions are introduced prior to carbonation or during carbonation a few minutes after the reaction starts.

While using detergents of the sulfonate type, the reaction mixture is subjected to a strong stirring while the introduction of from 50 to 350 parts by weight of carbonic anhydride starts by dipping in the reaction medium. The duration of the carbonation varies in general from 20 minutes to 4 hours at a constant delivery. The reaction is exothermal. The mixture is kept at a temperature range from 20° to 80° C., preferably from 35° to 70° C.

It may be advantageous to bring to reflux the reaction mixture containing the boron derivative for a duration of from 30 minutes to 2 hours prior to carbonation.

The solvents can be eliminated in a single step, but in general two steps are used. The solvents, with the exception of the hydrocarbon diluent, are eliminated by heating, then the solid residues are separated by centrifugation or filtration prior to the elimination of the hydrocarbon solvent.

The overalkalinized additives obtained by the process of the invention have alkaline values (AV), measured according to the standard ASTM D-2896, generally above 200 mg KOH/g. an AV above 300 and even 500 can be obtained.

In the case of using detergents of the phenolic type, the reaction mixture free of boron derivative is brought to reflux for at least a half hour. After cooling, the boron derivative is added. The introduction of carbonic anhydride and the subsequent treatment develop as before.

The overalkalinized phenates obtained have alkaline values (AV) generally above 150 mg KOH/g. An AV above 250 and even 320 can be obtained.

The quantity of boron incorporated can vary between 0.1 and 10% by weight, preferably 0.25 to 5%. This quantity is enough for bringing antiwear properties to the lubricant oils. The antiwear properties are measured by mechanical tests commonly used, as the method of the 4 balls wear (NF-E 48-617) and 4 balls extreme pressure (ASTM D 2783-69T or NF E 48-617) and the FALEX tests (ASTM D 32-33).

The additives according to the invention have a limpid appearance and keep a homogeneous consistency. They have viscosities sufficiently low to allow easy handling and they are compatible with the other additives customarily used in lubricant oils.

The overalkalinized additives are added to the lubricant oils of natural or synthetic origin in a concentration between 0.5 and 40% by weight, preferably between 1 and 30% by weight.

The examples that follow illustrate the invention without limiting it.

EXAMPLE 1

Comparative

In a 250-ml reactor provided with a stirrer, an inlet of carbonic gas and a coolant, there are introduced 27 g $C_{24}$-alkyl benzene sulfonic acid with 70% active matter, 35 g calcium hydroxide 97% pure, 13.3 ml methanol, 22.5 g oil 100N, 1.1 ml 20% ammonia, 150 ml xylene.

The mixture is stirred at 700 revolutions/minute and its temperature is adjusted at 49° C. The carbonic anhydride is introduced at a delivery of 230 ml/minute for 30 minutes. At the end of the reaction, the mixture is heated at 100° C. for eliminating the methanol and the water produced by the carbonation. The solid residues are eliminated by centrifugation and then filtration. The elimination of the xylene makes it possible to recover a fluid product of basicity (AV) equal to 420 mg KOH/g containing 18% calcium, which proves to be stable in dilution in mineral oils (absence of cloudiness after 1 month).

EXAMPLE 2

The procedure of Example 1 is repeated and, shortly thereafter, 5 g metaborate of sodium tetrahydrate are added to the reaction medium prior to the 10th minute of carbonation. There is gathered a product much more fluid than before, of AV 425, stable in oil, and having a boron content on the order of 0.37% by weight.

EXAMPLE 3

The process described in Example 1 is repeated with the difference of adding 2 g pulverized sodium tetraborate to the reaction medium prior to the 10th minute of carbonation. There is obtained a product of AV 403 mg KOH/g having a boron content of 0.45% by weight.

EXAMPLE 4

In a one-liter reactor thermostatically adjusted at 60° C. and containing 114 g oil 200 Neutral with 12.8% dispersant added, there is introduced under strong stirring 500 ml. of an aqueous solution at 80° C. containing 50 g/l sodium tetraborate. The aqueous solution is added drop by drop in 3 hours.

The homogeneous emulsion thus obtained is dehydrated as quickly as possible. There is thus obtained a fluid dispersion of sodium tetraborate at 17% by weight in oil.

EXAMPLE 5

Comparative

There is prepared a simple mixture of 13 g overalkalinized sulfonate of Example 1 with 3 g of the sodium tetraborate dispersion of Example 4. There is obtained a product of AV 350, containing 0.36% by weight boron, of cloudy appearance. The examination of the product with an electronic microscope shows the presence of calcium carbonate globules of 60 A diameter and of sodium borate particles of 0.6 μm diameter.

EXAMPLE 6

The procedure described in Example 3 is repeated with the difference of introducing 4 g diluent oil 200N instead of 22.5 g. Prior to the start of carbonation there are added 20.5 g of the sodium tetraborate dispersion of Example 4. There is then gathered a product of limpid appearance, of AV 369 mg KOH/g with 0.46% by weight boron.

The examination with a electronic microscope shows the presence of globules only of about 60 A diameter. The analysis of the globules for loss of energy gives a spectrum where there is observed a characteristic peak of the presence of boron. The procedure of Example 6 according to the invention makes it possible effectively to incorporate the boron in the globules of the colloidal suspension.

EXAMPLE 7

The procedure of Example 3 is repeated with the difference of introducing 30 grams calcium oxide, 10.2 ml water and of carbonating the product for 75 minutes with a delivery of 103 ml/minute. Prior to the 15th minute of carbonation there are added 9.52 g potassium tetraborate in powder form. There is gathered a limpid product of AV 310 mg KOH/g and containing 0.86% by weight boron.

EXAMPLE 8

The procedure of Example 7 is repeated, but the boron compound is boric acid. At the 10th minute of carbonation, 8.98 g boric acid in powder form are added. The product then obtained is of AV 411 mg KOH/g and of a very viscous consistency. It contains 1.23% by weight boron.

EXAMPLE 9

The procedure of Example 7 is repeated after having added only 4.5 ml methanol to the reaction medium. There is obtained a limpid, very fluid product, of AV 298 mg KOH/g and containing 1.3% by weight boron.

EXAMPLE 10

The procedure of Example 8 is repeated, but the diluent oil is replaced by 28.5 g of a boric acid dispersion in oil with about 5% by weight boron. This dispersion is introduced in the mixture prior to the start of carbonation. There is obtained a limpid product of AV 303 mg KOH/g and with 1.2% by weight boron.

EXAMPLE 11

The procedure of Example 8 is repeated, but there are added 11.2 g boron trioxide in powder form. The product gathered is limpid of AV 229 mg KOH/g containing 2.4% by weight boron.

EXAMPLE 12

The procedure of Example 7 is repeated, but 12.3 g trimethyl borate are added at the 10th minute of carbonation. The product then obtained is viscous of AV 437 mg KOH/g and with 1.2% by weight boron.

EXAMPLE 13

The procedure of Example 1 is repeated except for adding 9.53 g diammonium tetraborate in powder form after 10 minutes of carbonation. The product obtained is limpid, relatively fluid of AV 438 mg KOH/g and containing 1,15% by weight boron.

EXAMPLE 14

The procedure of Example 10 is repeated, but 19.06 g diammonium tetraborate are added under the same conditions. The product gathered is of AV 437 mg KOH/g and contains 1.95% by weight boron.

EXAMPLE 15

The procedure of Example 10 is repeated, but the additive is carbonated for 23 minutes at 148 ml/minute. The product then gathered is of AV 281 mg KOH/g and contains 2% by weight boron.

EXAMPLE 16

The same quantities of product as in the procedure described in Example 14 are introduced in the reactor. On the other hand, the reaction mixture is heated with reflux for 30 minutes prior to carbonation. The carbonation of the reaction mixture is carried out from the moment its temperature drops again to 49° C.

The subsequent treatment is in conformity with the procedure of Example 1. The product gathered is of AV 398 mg KOH/g and contains 1.7% by weight boron.

EXAMPLE 17

In a 250-ml reactor provided with a stirrer, an inlet of carbonic gas and a coolant there are introduced 30 g $C_{24}$-benzene sulfonic acid with 70% active matter, 23.4 g "light" magnesium oxide, 12 ml methanol, 30.6 g diluent oil 100 Neutral, 2.3 ml ammonia at 20%, 120 ml of a mixture 50/50 by volume of heptane and xylene. The carbonation is carried out for a duration of 3 hours, 30 minutes at a delivery of 45 ml/minute and a temperature of 53° C. After 35 minutes of carbonation, 8.7 g diammonium tetraborate tetrahydrate are added. The product recovered is limpid, containing 11% by weight magnesium, 1.15% by weight boron and the AV is 523 mg KOH/g.

EXAMPLE 18

The procedure of Example 1 is repeated except for using instead of $C_{24}$-benzene sulfonic acid, 23 g of a mixture 80/20 in mole of $C_{24}$-benzene sulfonic acid of a molar weight of 520 having 70% of active matter and carboxylic acid with $C_9$ obtained by hydroformylation of olefins (CK9 acid distributed by the company NORSOLOR). There are added 30.7 g of slaked lime with a purity of 97%. The carbonation is carried out for 25 minutes at a delivery of 210 ml/minute. After ten minutes of carbonation, 9.53 g diammonium tetraborate tetrahydrate are added. The product gathered is limpid and stable in dilution. Its AV is 307 mg KOH/g and its boron content is 1.55% by weight.

EXAMPLE 19

A solution of propylene glycol borate in xylene is prepared by heating at 50° C. while stirring a mixture of 46.4 g propylene glycol, 41 g boric acid and 300 ml xylene. The water formed is eliminated by azeotropic distillation. There are obtained 314 g of a solution with 2.6% boron; in the reactor described above in Example 1 there are introduced 34.6 g of the propylene glycol borate solution, 16.61 g $C_{16}$-alkyl benzene sulfonic acid with 96% of active matter and a molecular weight of 430, 24.4 g diluent oil, 112 ml xylene, 7 ml methanol and 23.8 g slaked lime with a purity of 99%.

The mixture is carbonated for 26 minutes at 42° C. with a delivery of 230 ml/minute.

After eliminating the water produced by the reaction, the methanol, the propylene glycol in excess, the solid residues and the solvent (by heating under reduced pressure), there is gathered a limpid light brown product of very low viscosity, of AV 302 and containing 0.87% boron.

EXAMPLE 20

There are introduced in the reactor described above, 8.3 g $C_{16}$-alkyl benzene sulfonic acid, 24.4 g diluent oil, 137 ml xylene, 7 ml methanol and 16.24 g slaked lime 96.5% pure. Prior to the carbonation there are added 19.84 g of a solution in xylene of the boric ester of N-eolyl dihydroxy ethylamine (NORAMOX $O_2$ of CECA S.A.) containing 1.03% boron. The mixture is carbonated with a delivery of 156 ml/minute for 26 minutes at a temperature of 42° C. The limpid product gathered has an AV of 351 and contains 0.36% boron.

EXAMPLE 21

In the reactor above described there are introduced 19.85 g $C_{16}$-alkyl-benzene-sulfonic acid, 1.1 ml 20% ammonia, 13 ml methanol, 30.8 g diluent oil and 116 ml xylene. There are added prior to carbonation 31.4 g of a solution of propylene glycol borate in xylene containing 2.6% boron. The medium is carbonated at 42° C. for 26 min. with a delivery of 254 ml/minute. The limpid, brown product has an AV 360 and contains 0.82% boron.

EXAMPLE 22

There are introduced in the reactor already described 17.86 g $C_{16}$-alkyl benzene sulfonic acid, 10.66 g succinimide with 50% by weight in oil, 1.1 ml 20% ammonia, 13 ml methanol, 30.8 g diluent oil and 116 ml xylene. Prior to carbonation, 31.4 g of a propylene glycol borate solution in xylene containing 2.6% boron are added. The carbonation under the conditions of Example 21 gives a product of AV 374 and containing 0.8% by weight boron.

EXAMPLE 23

Comparative

In a 250-ml reactor provided with a condenser, 77.8 g dodecyl-phenol and 20.04 g sulfur chloride are introduced. The mixture is then heated under stirring and nitrogen splashing for one hour at 150° C., then 1 hour at from 30° to 170° C. A blackish, viscous product consisting of sulfurized dodecyl-phenol is collected.

In a second reactor of 250 ml provided with a stirrer, a coolant and an inlet of carbonic acid, there are successively introduced 32 g sulfurized dodecyl-phenol, 24.5 g diluent oil of the type 100N, 16.8 g calcium hydroxide 97% pure, 25 ml of a 75/25 butanol/methanol mixture, 1 g $CaCl_2$, and finally 100 ml xylene.

The mixture is brought to reflux for 3 hours, then it is carbonated during 50 minutes with a delivery of about 90 ml/minute at a temperature of 53° C. The solvents and the hydrocarbonated diluent are eliminated by heating at 100° C. under reduced pressure. After hot filtration the product is characterized by an AV of 283 mg KOH/g, a calcium content of 11.2% by weight, and an acceptable stability when diluted in the oils.

EXAMPLE 24

The procedure of Example 19 is repeated with the difference that 6.75 g diammonium tetraborate in powder form are added to the reaction medium after 10 minutes of carbonation. The product obtained is relatively fluid, of AV 267 mg KOH, and contains 1.43% boron.

EXAMPLE 25

In a 250-ml reactor provided with a stirrer, an inlet of carbonic gas and a coolant, there are introduced 20.4 g $C_{24}$-benzene sulfonic acid with 70% active matter, 30 g calcium oxide in powder form, 5 ml methanol, 225 g oil 100N., 3.53 g phenyl boric acid, 1.16 g ammonium carbonate dissolved in 10.5 m. water, and 150 ml xylene. The carbonation is carried out under strong stirring, at a temperature of 52° C. and a delivery of 103 ml/minute for 75 minutes. The elimination of the solid residues and of the solvents results in a product of AV 303 ml KOH/g and containing 0.43% by weight boron.

EXAMPLE 26

In the reactor described above, there are introduced 43 g sulfurized dodecyl phenol prepared according to Example 23, 19.5 g slaked lime, 30 g oil 100N., 90 ml toluene and 49 ml methanol. The mixture is brought to reflux for at least thirty minutes.

After eliminating the water and the methanol, there are added 36.5 g of a solution in toluene of propylene glycol borate with 2.6% boron and 49 ml methanol. The mixture is carbonated to 85% at a temperature of 50° C. The limpid and greenish product obtained has an AV of 260 and contains 0.82% boron.

EXAMPLE 27

The operation is carried out like in the preceding Example, but before the carbonation 70 ml toluene and 18.3 g of propylene glycol borate solution with 2.6% boron are introduced. The limpid product of light green color obtained has an AV of 281 and a boron content of 0.42%.

EXAMPLE 28

The operation is carried out like in the preceding Example, but introducing 40 ml methanol and 36.5 g of the propylene glycol borate solution with 2.6% boron. The product has an AV of 267 and a boron content of 0.91%.

EXAMPLE 29

The operation is carried out like in the preceding Example, but introducing prior to carbonation 38 ml methanol and 20.6 g tributyl borate. The product has an AV of 273 and a boron content of 0.9%.

EXAMPLE 30

The operation is carried out like in the preceding Example, but introducing prior to carbonation 40.6 g tributyl borate and 28 ml methanol. The product has an AV of 265 and contains 1.8% boron.

EXAMPLE 31

The overalkalinized additives were subjected to the following mechanical tests:

4 ball wear: NF-E48-617

FALEX wear: D32-33

4 EP balls: D2783-69T E 48-617

The products are tested after dilution in the following oil mixture: 600N./BSS (Bright Stock Solvent)=80/20 up to an AV of 70 mg KOH/g or still 10 mg KOH/g. The table that follows shows by way of example a few results obtained, it is thus observed that the products obtained according to the invention have improved antiwear action and extreme pressure in relation to the overalkalinized product of the reference described in Example 1.

MECHANICAL TESTS

| TEST | Dilution | | Ex. 1 Comparative | Ex. 2 | Ex. 9 | Ex. 10 | Ex. 13 |
|---|---|---|---|---|---|---|---|
| FALEX | AV 70 | no. of teeth | 8 | 0 | 3 | 7 | 3 |
| | | weight loss in mg | 6.2 | 0 | 4.0 | 4.0 | 2 |
| 4 balls wear | AV 10 | diam. | 2.26 | 2.28 | 0.57 | 0.7 | 0.42 |
| | AV 70 | of imprint | 0.58 | 0.36 | 0.42 | 0.64 | 0.4 |
| 4 balls EP | AV 70 | abrasion (kgf) | 100 | 126 | 126 | 126 | 160 |
| | | welding (kgf) | 250 | 250 | 200 | 200 | 250 |
| | | CUI* | 46.3 | 53.3 | 50.4 | 50.2 | 61.2 |

*CUI: charge-wear index

We claim:

1. A process for the preparation of an overalkalinized additive with antiwear action which comprises subjecting a reaction mixture containing at least one detergent, an oxide, hydroxide or alcoholate of an alkaline or alkaline earth metal, at least one nitrogenized and/or oxygenated promoter, a diluent oil, a hydrocarbon solvent, to carbonation wherein prior to said carbonation or within a few minutes after the commencement of said carbonation, adding at least one boron derivative to the reaction mixture.

2. The process according to claim 1, wherein said boron derivative comprises at least one inorganic boron compound selected from the group consisting of boron oxides, boron anhydrides, boric acid and salts thereof.

3. The process according to claim 1 or claim 2, wherein said boron derivative comprises at least one inorganic boron compound selected from the group consisting of boric acid and the ammonium, sodium, potassium, and lithium salts thereof.

4. The process according to claim 1, wherein said boron derivative comprises at least one organic compound selected from the group consisting of boric acid esters alkyl boric acid, alkyl boric acid esters, aryl boric acid and aryl boric acid esters.

5. The process according to claim 4, wherein at least one of said esters comprises a linear or branched chain aliphatic alcohol residue having from 1 to 20 carbon atoms.

6. The process according to claim 4, wherein at least one of said esters comprises at least one glycol residue selected from the group consisting of a residue of glycol, propylene glycol, neopentyl glycol, diethylene glycol, dipropylene glycol, neopentyl glycol, diethylene glycol, diproplyene glycol, and tripropylene glycol.

7. The process according to claim 4, wherein at least one of said esters comprises at least one polyol residue selected from the group consisting of residues of glycerol, trimethylol propane, and pentaerythritol.

8. The process according to claim 4, wherein at least one of said esters comprises residues of alcohols which contain at least one amine function.

9. The process according to claim 8, wherein said alcohol residue containing at least one amine function is an alkanolamine residue selected from the group consisting of diethanolamine and triethanolamine.

10. The process according to claim 8, wherein said alcohol residue containing at least one amine function is a residue of an oxyalkylated alkyl monoamine of the formula $R_2NH_cZ_d$, wherein $R_2$ is hydrogen or an alkyl group having from 1 to 22 carbon atoms, Z is a group—$CHR_3$—$CH_2OH$, $R_3$ being an alkyl group with from 1 to 4 carbon atoms or an aromatic nucleus, c is 0 or 1 and c+d is equal to 2.

11. The process according to claim 8, wherein said alcohol residue containing at least one amine function is the residue of an oxyalkylated alkyl polyamine.

12. The process according to claim 4, wherein at least one of said esters comprises a cyclic alcohol residue selected from the group consisting of residues of cyclopentanol, cyclohexanol and mono-and polyalkylated derivatives thereof.

13. The process according to claim 4, wherein at least one of said ester comprises phenol residues.

14. The process according to claim 4 further comprising adding said boron derivative in the form of a dispersion in diluent oil to the reaction mixture prior to introducing a carbonic anhydride as the carbonation agent.

15. The process according to claim 4 wherein said boron derivative in the form of a powder, a liquid, or an aqueous solution is introduced into the reaction mixture during the carbonation reaction.

16. The process according to claim 4 wherein said reaction mixture contains at least one detergent selected from the group consisting of the sulfonic acids of petroleum of synthetic origin, salicyclic acids, phenols and alkali metal or alkaline earth metal salts thereof.

17. The process according to claim 4 wherein said detergent is mixed with an alkyl succinimide of the formula

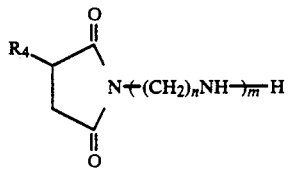

wherein $R_4$ is a hydrocarbon radical containing from 12 to 100 carbon atoms, n comprises 1 to 6 and m comprises 1 to 5.

18. The process according to claim 4 wherein said reaction mixture contains at least one composition selected from the group consisting of alkaline earth metal oxides, alkaline earth metal hydroxides, and alkaline earth metal alcoholates.

19. The process according to claim 4 wherein said reaction mixture contains at least one oxygenated promoter selected from the group consisting of aliphatic alcohols having from 1 to 5 carbon atoms, glycols, and glycol ethers.

20. The process according to claim 4, wherein said reaction mixture contains water.

21. The process according to claim 4, wherein said reaction mixture contains a paraffinic or naphthenic diluent oil.

22. The process according to claim 4, wherein said reaction mixture contains at least one aliphatic or aromatic hydrocarbon solvent.

23. The process according to claim 4, wherein the reaction mixture contains from 100 to 500 parts by weight of at least one detergent, from 100 to 300 parts by weight of a derivative of an alkaline or alkaline earth metal, from 0 to 100 parts by weight of a nitrogenized promoter, from 30 to 300 parts by weight of an oxygenated promoter, from 0 to 100 parts by weight of water, from 100 to 500 parts by weight of diluent oil, from 200 to 800 parts by weight of a hydrocarbon solvent and from 15 to 400 parts by weight of a boron derivative, 50 to 350 parts by weight of a carbonic anhydride, said process comprising conducting the reaction at a temperature of from 20° to 80° C., for a period of from 20 minutes to 4 hours.

24. The process according to claim 4, wherein said reaction mixture is heated to reflux for 30 minutes to 2 hours prior to carbonation.

25. An overalkalinized antiwear additive prepared according to the process of claim 4 containing from about 0.1 to about 10% by weight of boron.

26. A lubricant composition which contains a natural or synthetic lubricant oil and from about 0.5 to about 40% by weight of an additive of claim 25.

27. The process according to claim 4, wherein said esters comprise at least one residue of an alkoxyalkanol of the formula $$RO(CHR_1(CH_2)_a—O—)_bH$$

wherein R is an alkyl group having 1 to 4 carbon atoms, $R_1$ is hydrogen or an alkyl group having from 1 to 3 carbon atoms, a is 1 to 3 and b is 1 or 2.

28. The process according to claim 4, wherein the reaction mixture further comprises an alkyl succinimide.

29. The process according to claim 4, wherein said esters comprise at least one polyol residue selected from the group consisting of residues of glycerol, trimethylol propane, and pentaerythritol.

* * * * *